US008045887B2

(12) United States Patent
Sakashita et al.

(10) Patent No.: US 8,045,887 B2
(45) Date of Patent: Oct. 25, 2011

(54) IMAGE FORMING APPARATUS

(75) Inventors: Takeshi Sakashita, Osaka (JP); Tomofumi Inoue, Osaka (JP); Yuuji Meguro, Hyogo (JP); Takeru Muramatsu, Osaka (JP); Kohji Hatayama, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 416 days.

(21) Appl. No.: 11/747,542

(22) Filed: May 11, 2007

(65) Prior Publication Data

US 2008/0028967 A1 Feb. 7, 2008

(30) Foreign Application Priority Data

Jun. 12, 2006 (JP) ..... 2006-162866

(51) Int. Cl.
*G03G 15/08* (2006.01)

(52) U.S. Cl. ..... 399/121; 399/124; 399/302

(58) Field of Classification Search ..... 399/101, 399/110, 121, 124, 125, 302, 303, 312
See application file for complete search history.

(56) References Cited

U.S. PATENT DOCUMENTS

2003/0053819 A1* 3/2003 Nomura et al. ..... 399/110
2005/0074259 A1* 4/2005 Tachiki et al. ..... 399/121
2006/0062593 A1* 3/2006 Takahashi ..... 399/121
2006/0140669 A1* 6/2006 Sato ..... 399/110

FOREIGN PATENT DOCUMENTS

| | | |
|---|---|---|
| JP | 6-130867 | 5/1994 |
| JP | 2514875 | 8/1996 |
| JP | 10-20595 | 1/1998 |
| JP | 2000-235309 | 8/2000 |
| JP | 2002-139876 | 5/2002 |

OTHER PUBLICATIONS

U.S. Appl. No. 12/125,653, filed May 22, 2008, Inoue, et al.
U.S. Appl. No. 11/746,258, filed May 9, 2007, Sakashita, et al.

* cited by examiner

*Primary Examiner* — David Porta
*Assistant Examiner* — Benjamin Schmitt
(74) *Attorney, Agent, or Firm* — Oblon, Spivak, McClelland, Maier & Neustadt, L.L.P.

(57) ABSTRACT

An intermediate transfer unit includes a stand member that is integral with an intermediate-transfer-unit body of the intermediate transfer unit. The stand member stretches below the intermediate-transfer-unit body from a trailing edge to a leading edge of the intermediate-transfer-unit in an attachment direction of the intermediate transfer unit.

31 Claims, 13 Drawing Sheets

IMAGE FORMING APPARATUS

CROSS-REFERENCE TO RELATED APPLICATIONS

The present document incorporates by reference the entire contents of Japanese priority document, 2006-162866 filed in Japan on Jun. 12, 2006.

BACKGROUND OF THE INVENTION

1. Field of the Invention

The present invention relates to an image forming apparatus. More specifically, the present invention relates to an image forming apparatus that includes a unit that can be detachably attached to a body of the image forming apparatus.

2. Description of the Related Art

A conventional image forming apparatus of the above type is disclosed in Japanese Patent Application Laid-open No. 2000-235309. The conventional image forming apparatus includes an intermediate-transfer-belt unit that can be detachably attached to a body of the image forming apparatus (hereinafter, "image forming-apparatus body"). A user can attach the intermediate-transfer-belt unit to the image-forming-apparatus body by inserting and pushing it into a space between two side walls of the image forming-apparatus body, or can detach it by pulling it toward the user. During the process of the attachment or detachment, the intermediate-transfer-belt unit is not in contact with a bottom surface of the image-forming-apparatus body. The image forming apparatus further includes guide rails that support the intermediate-transfer-belt unit during a process of the attachment or detachment.

When attaching the intermediate-transfer-belt unit to the image-forming-apparatus body, the user grips a portion on a trailing edge (hereinafter, "trailing edge portion") of the intermediate-transfer-belt unit in a direction in which the intermediate-transfer-belt unit is inserted into the apparatus body. Then, the user puts, on the guide rails, guide contact members on a leading edge of the intermediate-transfer-belt unit in the insertion direction of the intermediate-transfer-belt unit, and pushes the intermediate-transfer-belt unit into the image-forming-apparatus body along the guide rails. When detaching the intermediate-transfer-belt unit to the image-forming-apparatus body, the user pulls forward the intermediate-transfer-belt unit along the guide rails, and lifts up the intermediate-transfer-belt unit before the guide contact members come off the guide rails.

Because the guide rails support the intermediate-transfer-belt unit during the detachment or attachment, the intermediate-transfer-belt unit can be detached from or attached to the image-forming-apparatus body without making a physical contact with the bottom surface of the image forming apparatus.

However, sometimes the user may relax the grip on the front edge portion of the intermediate-transfer-belt unit even though the guide contact members are not yet put on the guide rails. In such a case, the intermediate-transfer-belt unit pivots on the trailing edge portion that the user grips such that the leading portion of the intermediate-transfer-belt unit falls. The leading portion may bump against and damage, for example, the bottom surface of the image-forming-apparatus body, or the intermediate-transfer-belt unit itself may get damaged.

Similarly, during detachment of the intermediate-transfer-belt unit, the intermediate-transfer-belt unit may pivot on the trailing edge portion that the user grips and the leading edge of the intermediate-transfer-belt unit may fall, in case the guide contact members come off the guide rails before the user lifts up the intermediate-transfer-belt unit. Even in this case, the leading edge of the intermediate-transfer-belt unit can bump and damage, for example, the bottom surface of the image-forming-apparatus body, or the intermediate-transfer-belt unit itself can get damaged.

Although the intermediate-transfer-belt unit is explained above as a unit that can be detachably attached to the image-forming-apparatus body, any unit can have the above drawbacks as long as the unit can be detached from or attached to the image-forming-apparatus body while being supported by guide rails and being not in contact with the bottom surface of the image-forming-apparatus body.

SUMMARY OF THE INVENTION

It is an object of the present invention to at least partially solve the problems in the conventional technology.

According to an aspect of the present invention, an image forming apparatus includes an apparatus body that has two side surfaces, which are opposed to each other, and a bottom surface; and an upper unit that can be detachably attached to the apparatus body in a space between the two side surfaces by movement in an attachment/detachment direction that is parallel to the two side surfaces and the bottom surface. The upper unit includes a unit body and a unit leg that extends from the unit body toward the bottom surface and that is positioned at least on a portion of the unit body that is relatively interior of the apparatus body with respect to the attachment/detachment direction, and the upper unit is configured so that the unit body is not in contact with the bottom surface when the upper unit is attached to or detached from the apparatus body.

According to another aspect of the present invention, an image forming apparatus includes an apparatus body that has two side surfaces, which are opposed to each other, and a bottom surface; and an upper unit that can be detachably attached to the apparatus body in a space between the two side surfaces by movement in an attachment/detachment direction that is parallel to the two side surfaces and the bottom surface. The upper unit includes a unit body and a unit leg that extends from the unit body toward the bottom surface, the upper unit is configured so that the unit body is not in contact with the bottom surface when the upper unit is attached to or detached from the apparatus body, and the unit leg is configured so that a lower edge of the unit leg slides on the bottom surface during a process of attachment or detachment of the upper unit from the apparatus body.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
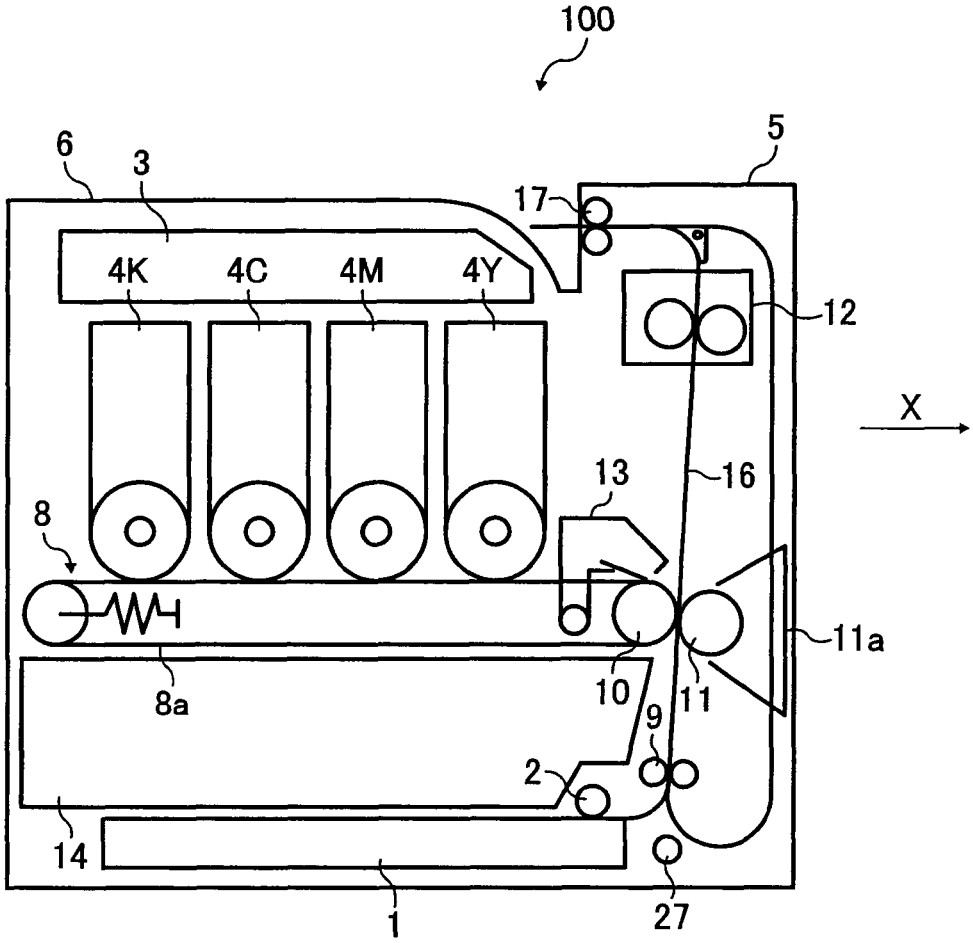
FIG. 1 is a schematic side view of a printer according to an embodiment of the present invention.

FIG. 1 is a schematic side view of a printer 100 according to an embodiment of the present invention. The printer 100 is a full color printer. The printer 100 is an example of an image-forming apparatus.

The printer 100 includes an intermediate transfer unit 80 almost at the center in an image-forming-apparatus body. The intermediate transfer unit 80 includes an intermediate transfer belt 8*a* that is wound around and extends across a plurality of rollers. Along an upper surface of the intermediate transfer belt 8*a*, four image forming units 4 (4K, 4C, 4M, and 4Y) are arranged. Above the image forming units 4 is arranged an exposure unit 3 that applies each light beam to each photoreceptor of each of the image forming units 4K, 4C, 4M, and 4Y. Below the image transfer unit body is arranged a collected-toner box 14 for storing residual toner residing on the intermediate transfer belt 8*a* and residing on the surfaces of the photoreceptors after the residual toner is removed and collected. Below the collected-toner box 14, furthermore, a sheet cassette 1 is arranged.

On the right of the intermediate transfer unit 80 shown in FIG. 1, a secondary transfer unit 11*a* that includes a secondary transfer roller 11 is provided. Above the secondary transfer roller 11, a fixing unit 12 is arranged. The intermediate transfer belt 8*a* has a portion that is opposed to the secondary transfer roller 11 and that is supported by a transfer opposed roller 10. The portion serves as a secondary transfer point.

A full color image is formed in the following manner. The exposure unit 3 applies a light beam to each of the surfaces of the photoreceptors of the image forming units 4K, 4C, 4M, and 4Y so that color toner images are formed on the surfaces of the photoreceptors. The color toner images are primary-transferred to the intermediate transfer belt 8*a* at primary transfer points where the photoreceptors and the intermediate transfer belt 8*a* are opposed. Accordingly, a layered color-toner image is formed on the surface of the intermediate transfer belt 8*a*.

Transfer sheets stacked on the sheet cassette 1 are fed by a feeding roller 2 one by one and reach resist rollers 9. The resist rollers 9 conveys the transfer sheet at a timing when the layered color-toner image on the intermediate transfer belt 8*a* reaches the secondary transfer point, and the layered color-toner image is transferred to the transfer sheet at the secondary transfer point.

The layered color-toner image on the transfer sheet is fixed by the fixing unit 12 and then discharged by discharging rollers 17. Residual toner residing on the intermediate transfer belt 8*a* is removed by a cleaning unit 13, using a cleaning mechanism, and stored in the collected-toner box 14. The collected-toner box 14 can be configured to store residual toner collected from the surfaces of the photoreceptors of the image forming units 4.

A user stands on the side of an arrow X shown in FIG. 1 (hereinafter, "front side") and performs operations including maintenance work of the printer 100 and replacement work of consumed parts.

Figure 2:
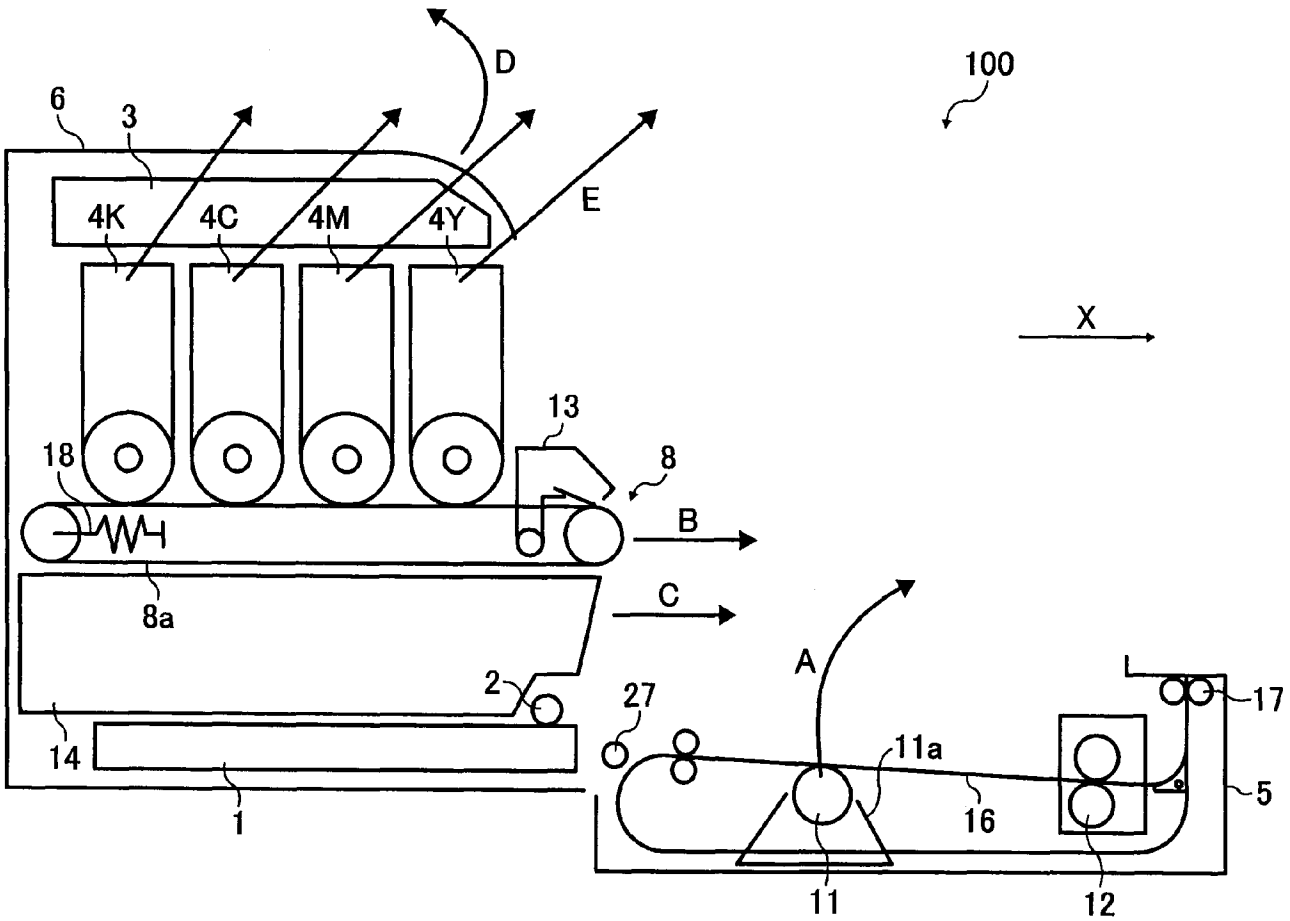
FIG. 2 is a schematic side view of the printer with an exterior front cover open.

FIG. 2 is a schematic side view of the printer 100, whose exterior front cover 5 is open, for explaining directions in which the units of the printer 100 are detached from a printer body of the printer 100 (hereinafter, "detachment direction"). The exterior front cover 5 is caused to pivot on an exterior-front-cover pivot shaft 27 to open in the direction indicated by the arrow X shown in FIG. 1. Accordingly, the secondary transfer unit 11*a*, the intermediate transfer unit 80, and the collected-toner box 14 can be detached from the printer body respectively in the directions indicated by arrows A, B, and C shown in FIG. 2. An exterior upper cover 6 is caused to pivot and open in the direction indicated by an arrow D shown in FIG. 2 to detach the image forming units 4K, 4C, 4M, and 4Y from the printer body in the directions indicated by arrows E shown in FIG. 2.

If the printer is small-sized, layout of the units is required to assure space for each of the units and not to cause interference among the units during detachment or attachment of the units.

Figure 3:
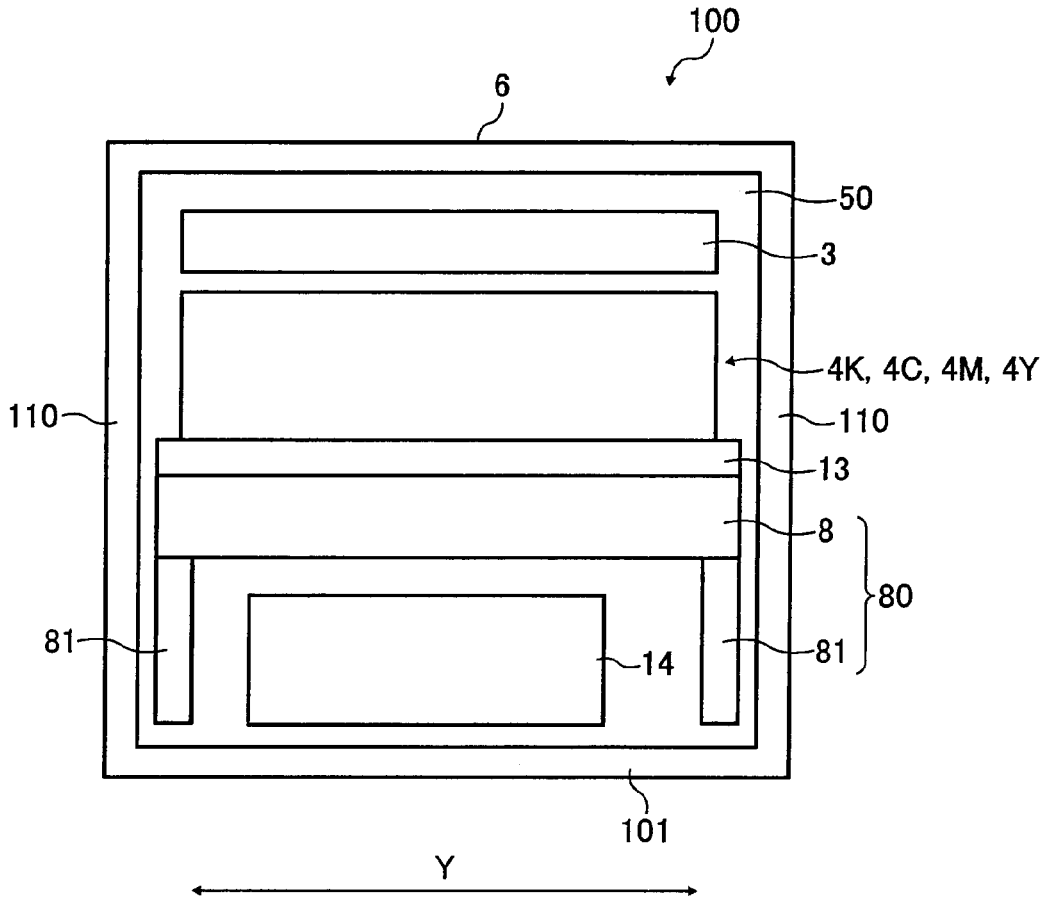
FIG. 3 is a schematic front view of the printer with the exterior front cover open.

FIG. 3 is a schematic front view of the printer 100, viewed from the side of the arrow X shown in FIG. 2, whose exterior front cover 5 is open. The units that can be detachably attached to the printer 100 are attached to the printer 100 so as to be seen from a certain side at a time. Accordingly, all of the units can be detached in the directions indicated by the arrow X shown in FIG. 2.

As shown in FIG. 3, the intermediate transfer unit 80 is attached to the printer 100 such that the intermediate transfer unit 80 is housed in a unit attachment space 50 defined by two side plates 110 serving as side surfaces, a bottom plate 101 serving as a bottom surface, and the exterior upper cover 6. When the exterior front cover 5 opens, a boundary between the unit attachment space 50 and the outside of the printer 100 serves as an opening. As shown in FIG. 3, the intermediate transfer unit 80 is attached to the printer 100 so as not to be in contact with the bottom plate 101 and positioned above the collected-toner box 14. The intermediate transfer unit 80 serves as an upper unit and the collected-toner box 14 serves as a lower unit. An intermediate-transfer-unit body 8 of the intermediate transfer unit 80 includes the intermediate transfer belt 8*a* that is positioned above the bottom plate 101 and that is not in contact with the collected-toner box 14. The intermediate transfer unit 80 includes two stand members 81 each serving as a unit leg. Each of the stand members 81 is on each of the two edges of the intermediate-transfer-unit body 8 in a unit width direction (the direction indicated by an arrow Y shown in FIG. 3) and extends from the intermediate-transfer-unit body toward the bottom plate 101. When the intermediate transfer unit 80 and the collected-toner box 14 are attached to the printer 100, each of the stand members 81 is positioned exterior of each of the edges of the collected-toner box 14 in the unit width direction as shown in FIG. 3, and the intermediate transfer unit 80 crosses the collected-toner box 14.

As against the printer 100, the conventional image forming apparatus includes guide rails that support the two side edges of the intermediate transfer unit 80 to guide the intermediate transfer unit 80, and that are positioned in an upper portion of the printer body. To attach the intermediate transfer unit 80 to the conventional image forming apparatus, a user grips a portion on the trailing edge portion of the intermediate transfer unit 80 in the attachment direction, and lifts up a leading edge of the intermediate transfer unit 80 in the attachment direction. After knowing that the leading edge is put on the guide rails, the user relaxes the grip on the trailing edge portion and pushes the intermediate transfer unit 80 into the apparatus body while gripping the trailing edge portion. In this manner, the intermediate transfer unit 80 is attached to the conventional image forming apparatus. However, sometime, although the leading edge is not yet put on the guide rails, the user relaxes the grip so that the intermediate transfer unit 80 pivots on the trailing edge portion that the user grips and the leading edge falls. As a result, the intermediate-transfer-unit body 8 bumps against, for example, the bottom plate 101 so that the intermediate transfer unit 80 is damaged.

Similarly, sometimes, the intermediate transfer unit 80 is damaged in the process of detaching the intermediate transfer unit 80 from the conventional image forming apparatus. This happens in case the user fails to grip the trailing edge portion firmly to lift up the leading edge at the timing when the leading edge comes off the guide rails, and thus, the intermediate transfer unit 80 pivots on the trailing edge portion that the user grips and the leading edge falls so that the intermediate transfer unit 80 bumps against, for example, the bottom plate 101.

On the other hand, as shown in FIG. 3, the printer 100 according to the first embodiment includes the stand members 81 that are integral with the intermediate-transfer-unit body. Each of the stand members 81 stretches below the intermediate-transfer-unit body 8 from the leading edge to the trailing edge of the intermediate-transfer-unit body 8 along the attachment direction as shown in FIG. 4 that is explained below. In other words, the stand members 81 are positioned also on the leading edge of the intermediate-transfer-unit body 8 in the attachment direction. Accordingly, when the intermediate transfer unit 80 is to pivot on the trailing edge portion gripped by the user in a process of attachment or detachment of the intermediate transfer unit 80, leading edges of the stand members 81 in the attachment direction prevents pivoting of the intermediate transfer unit 80. In this manner, the leading edge of the intermediate transfer unit 80 can be prevented from falling and bumping against, for example, the bottom plate 101.

Furthermore, the lower edge of each of the stand members 81 of the printer 100 is in contact with the bottom plate 101 during the detachment/attachment process. Hence, by sliding the intermediate transfer unit 80 while the lower edges of the stand members 81 are in contact with the bottom plate 101, the intermediate transfer unit 80 can be detached from and attached to the printer body. Accordingly, the leading edge of the intermediate transfer unit 80 can be prevented from falling and damaging, for example, the bottom plate 101 when the user fails to grip properly the trailing edge portion of the intermediate transfer unit 80.

Because the stand members 81 are provided to the two edges of the intermediate-transfer-unit body in the unit width direction, the lower edges of the stand members 81 can be kept being in contact with the bottom plate 101 without a force to be vertically applied to the intermediary transfer unit 80. Accordingly, by applying only a force in the attachment/detachment direction for sliding the intermediate transfer unit 80, the intermediate transfer unit 80 can be attached to and detached from the printer body.

Figure 4A:
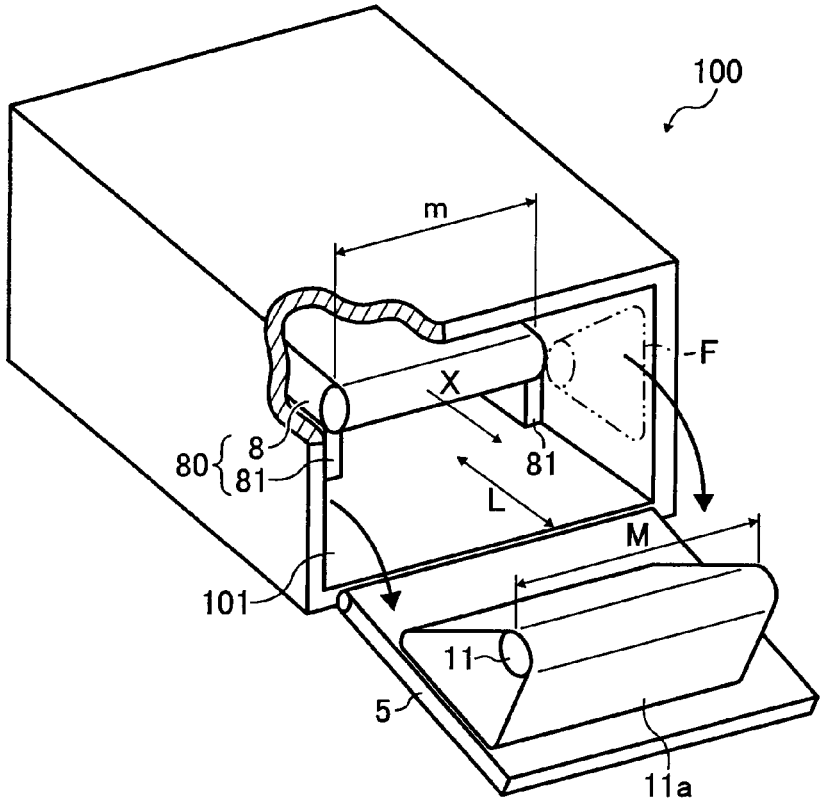
FIGS. 4A and 4B are schematic perspective views of the printer for explaining an operation for removing out each unit from the inside of the printer.
Figure 4B:
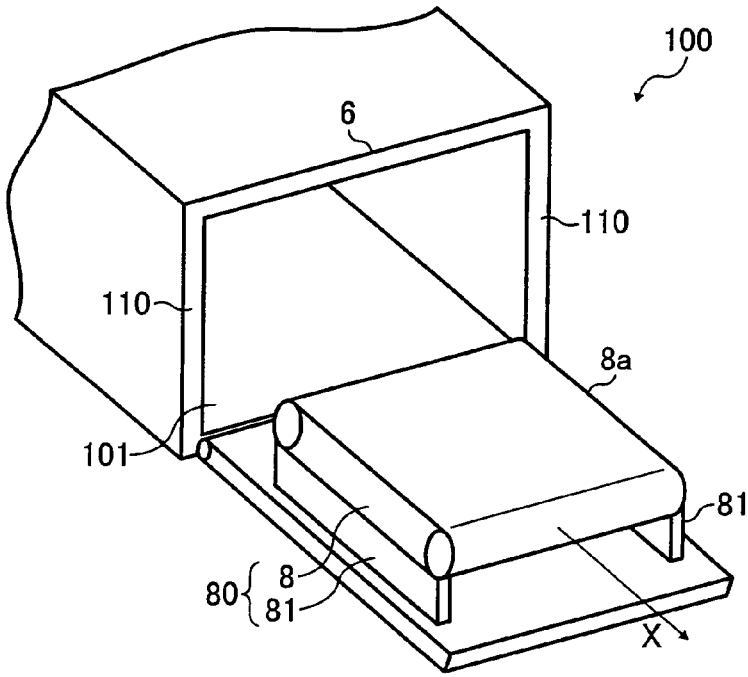

FIGS. 4A and 4B are schematic perspective views of the printer 100 for explaining an operation for detaching the intermediate transfer unit 80 and the secondary transfer unit 11*a* from the printer body. FIG. 4A depicts the state where the exterior front cover 5 is open, and FIG. 4B depicts the state after the intermediate transfer unit 80 is removed out by pulling forward from the printer body.

To pull the intermediate transfer unit 80 from the printer body in the direction indicated by an arrow X shown in FIG. 4A, the exterior front cover 5 opens in a direction indicated by an arrow shown in FIG. 4A. The intermediate transfer unit 80 needs to be moved from a position more interior in the printer body than a space F is where the secondary transfer unit 11*a* is positioned when the exterior front cover 5 is closed. The secondary transfer unit 11*a* serves as an opening-side unit. The width M of the secondary transfer unit 11*a* shown in FIG. 4A is longer than the width m of the intermediate transfer unit 80 as shown in FIG. 4A.

In an image forming apparatus that includes guide rails arranged in the apparatus body, if the width of the secondary transfer unit is equal to or larger than the width of the intermediate transfer unit, the guide rails cannot be positioned in the space F shown in FIG. 4A for the secondary transfer unit 11*a*. In other words, the guide rails are positioned in a portion more interior of the apparatus body than a portion is that extends as indicated by an arrow L shown in FIG. 4A, and cannot extend to the opening that is the boundary between the unit attachment space 50 and the outside of the printer 100. This makes it difficult for the user to know the timing when portions of the intermediate transfer unit 80 that are supported by the guide rails come off the guide rails. If the user fails to know the timing properly, the supported portions come off and fall. Accordingly, the intermediate transfer unit 80 may fall and bump against, for example, the bottom plate 101 and the intermediate transfer unit 80 may be damaged in the worst case. Because the edges of the guide rails that face the opening are positioned in the apparatus body at relatively the rear side of the printer body, the user cannot see easily the position of the guide rails. Also because of the position of the guide rails, the intermediate transfer unit 80 may bump against other members of the image forming apparatus so that the intermediate transfer unit 80 and other members may get damaged.

On the other hand, as shown in FIG. 4B, the printer 100 includes the stand members 81 that are integral with the intermediate-transfer-unit body 8, and the stand members 81 support the intermediate-transfer-unit body 8 even after the intermediate transfer unit 80 is removed out of the printer body. Accordingly, the intermediate transfer unit 80 can be detached and attached to the printer 100 properly not as in the case of the image forming apparatus described above where the space for the secondary transfer unit 11*a* causes the above inconvenience. Note that the cleaning unit 13 is fixed to the intermediate transfer unit 80 and can be attached to and detached from the printer body along with the intermediate transfer unit 80.

To detach the intermediate transfer unit 80, the collected-toner box 14, and the secondary transfer unit 11*a* from the printer 100, the exterior front cover 5 opens as shown in FIGS. 2 and 4A. When the exterior front cover 5 opens, the secondary transfer unit 11*a* originally fixed to the exterior front cover 5 is pulled forward from the printer body as shown in FIG. 4A. Thereafter, the secondary transfer unit 11*a* is detached from the exterior front cover 5. Subsequently, the collected-toner box 14 originally positioned below the intermediate transfer unit 80 is detached from the printer body while being horizontally pulled forward in the direction indicated by the arrow C shown in FIG. 2. The intermediate transfer unit 80 is then horizontally pulled forward from the printer body in the direction indicated by the arrow B shown in FIG. 2 as shown in FIG. 4B, and detached from the printer body. The stand members 81 serve as guide members during the detachment/attachment process.

Figure 5:
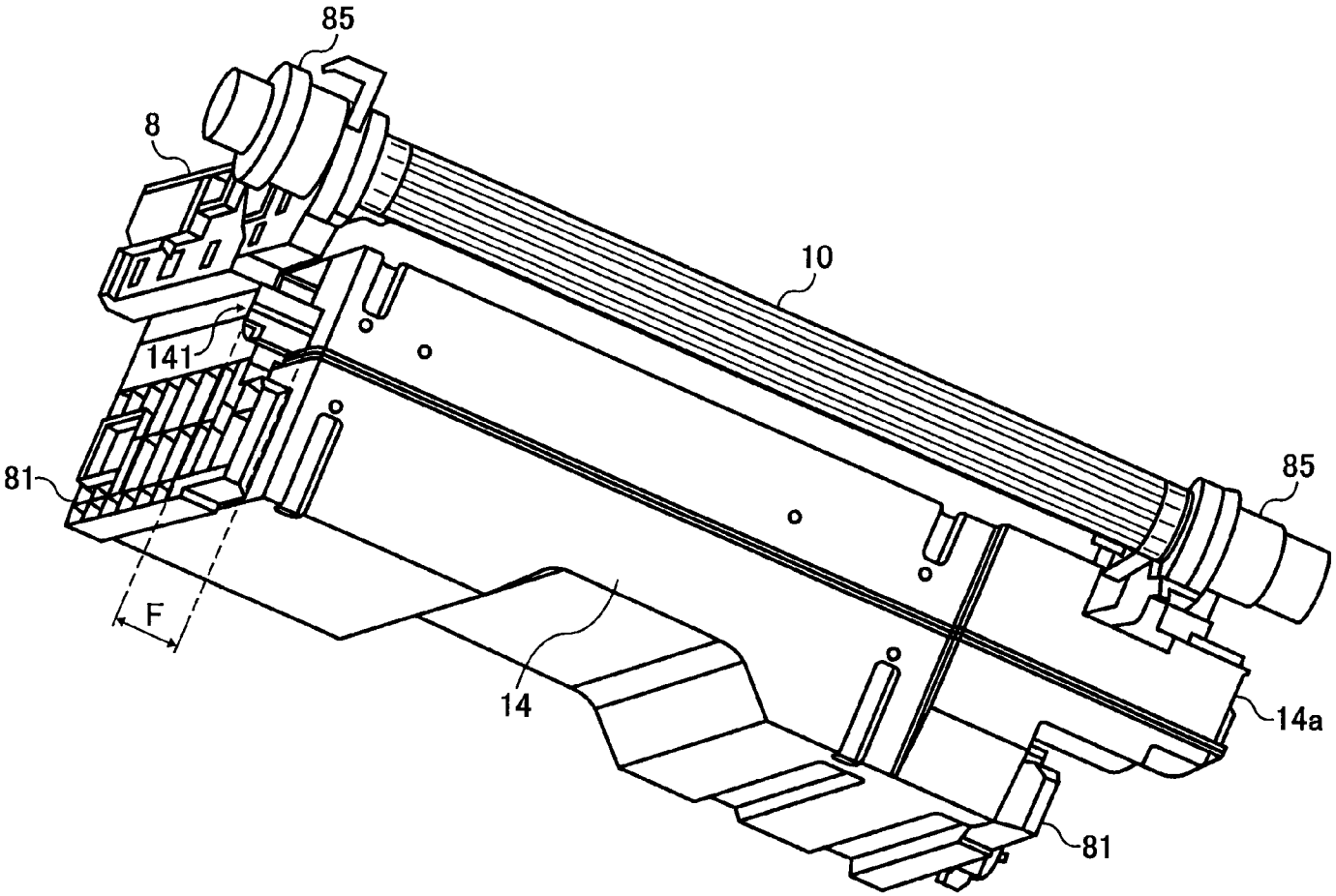
FIG. 5 is a perspective view of an intermediate transfer unit and a collected-toner box.
Figure 6:
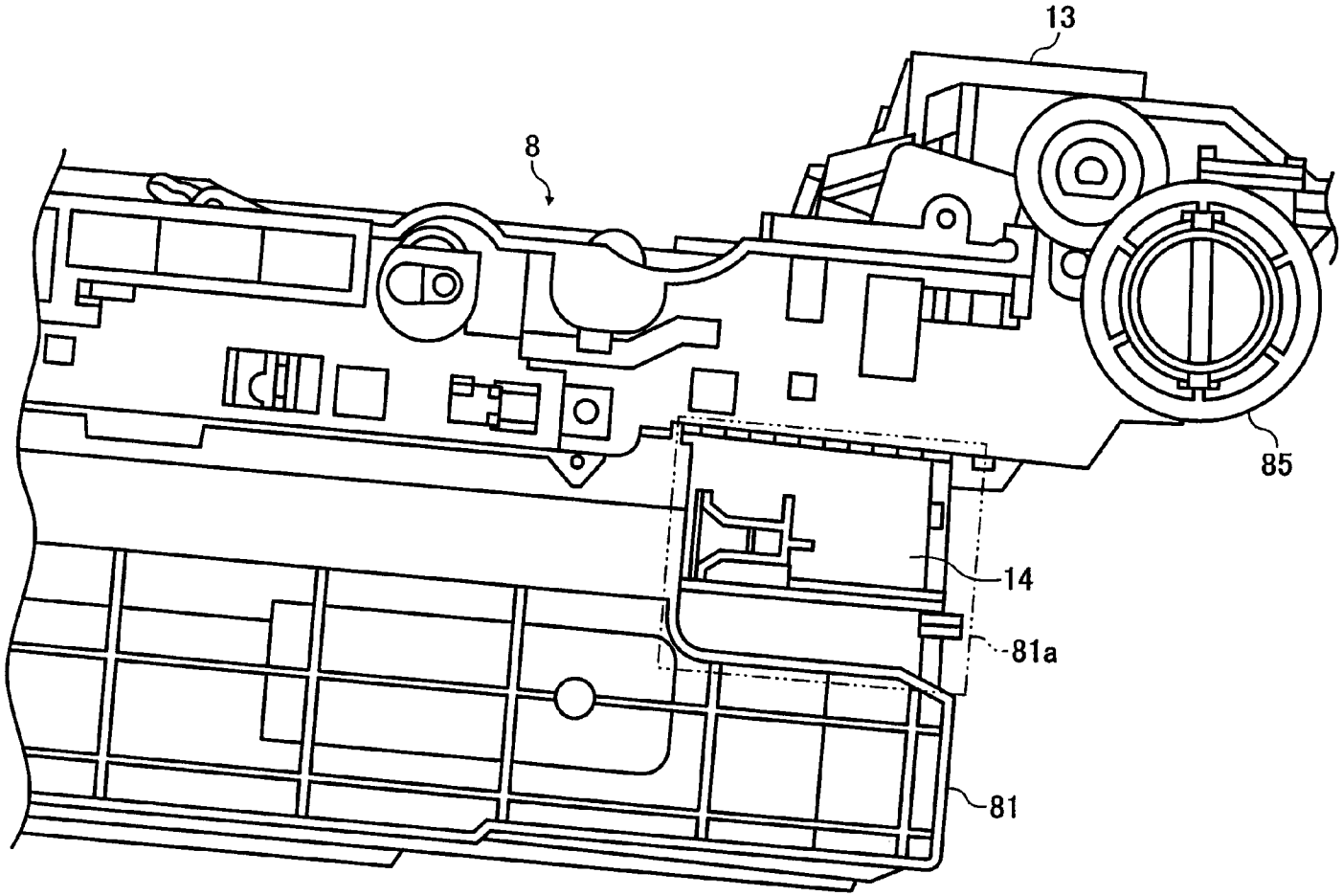
FIG. 6 is an enlarged left side view of the intermediate transfer unit and the collected-toner box.

FIG. 5 is a perspective view of the intermediate transfer unit 80 and the collected-toner box 14 that are attached to the printer 100 and that are viewed from approximately from the front side (the side of the arrow X shown in FIG. 1). FIG. 6 is an enlarged left side view of front portions of the intermediate transfer unit 80 and the collected-toner box 14 in FIG. 5.

To position the collected-toner box 14 on the side plates 110, a positioning pin 141 needs to be pulled out of the collected-toner box 14. However, as shown in FIG. 3, each of the stand members 81 in the printer body is exterior of each of the edges of the collected-toner box 14 in the unit width direction, thus interrupting the positioning of the collected-toner box 14. To prevent such interruption, a cutout 81*a* is formed in the stand member 81 as shown in FIG. 6.

Instead of the positioning pin 141 provided to the collected toner box 14, a hole for positioning the collected-toner box 14 can be provided in the collected-toner box 14 and the positioning pin 141 can be provided to the side plates 110. However, the positioning pin 141 that is laid across the collected-toner box 14 and the printer body is laid on the path, through which the stand member 81 is pulled forward, and interrupts the intermediate transfer unit 80 from being pulled forward along the path. To allow the intermediate transfer unit 80 to be pulled forward, the printer 100 has a space having a width F shown in FIG. 5 that is larger than the width of the stand member 81, and the positioning pin 141 is laid across the space when the collected-toner box 14 is attached to the printer 100. With the above structure, the stand member 81 can be pulled forward along with the intermediate-transfer-unit body 8 after the collected-toner box 14 is pulled forward from the printer body.

Figure 7:
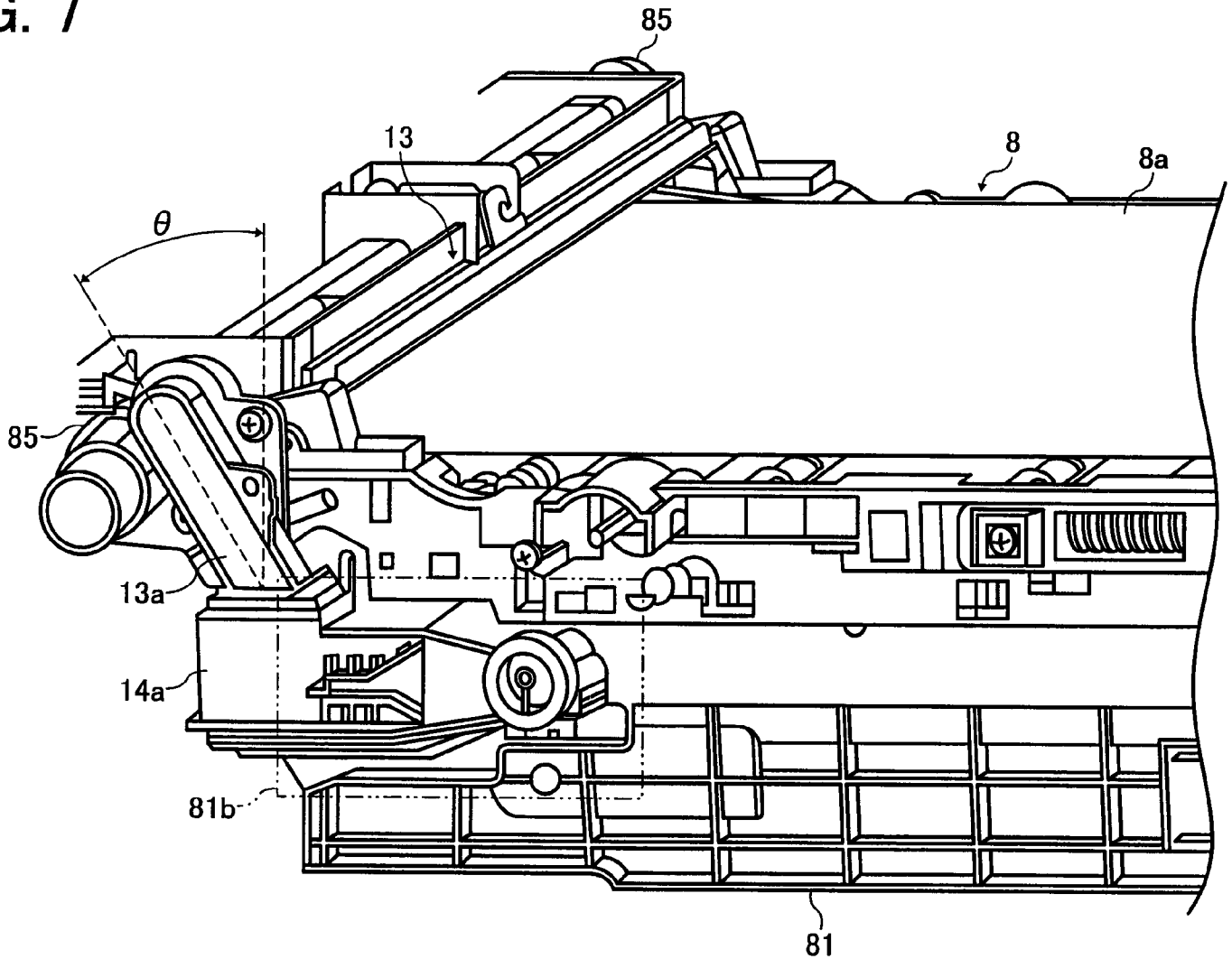
FIG. 7 is an enlarged right side view of the intermediate transfer unit and the collected-toner box.

FIG. 7 is an enlarged right side view of the front portions of the intermediate transfer unit 80 and the collected-toner box 14 in FIG. 5. The residual toner residing on the intermediate transfer belt 8*a* is removed by the cleaning unit 13, and then, it is conveyed to the collected-toner box 14 through a collection duct 13*a* and an introducing portion 14*a*. Because the cleaning unit 13 is positioned above the intermediate transfer unit 80 and the collected-toner box 14 is positioned below the intermediate transfer unit 80, a duct cutout 81*b* is provided to the stand member 81 to connect the cleaning unit 13 and the collected-toner box 14, which would otherwise be not connected because of the stand member 81. Accordingly, the cleaning unit 13 and the collected-toner box 14 can be connected with the collection duct 13*a*. The body of the collected-toner box 14 is block-shaped in conformity with the shape of the printer 100 and has the most compact shape. However, the collection duct 13*a* needs to connect the cleaning unit 13 and the collected-toner box 14 so as not to overlap the intermediate transfer unit 80 positioned between the cleaning unit 13 and the collected-toner box 14. For this reason, the introducing portion 14*a* juts out of the block-shaped body of the collected-toner box 14 as shown in FIGS. 5 and 7.

Because the collection duct 13*a* that serves as a toner conveying path is closer to a position where the collection duct 13*a* is vertical, the toner falls into the collected-toner box 14 by gravity. More specifically, as shown in FIG. 7, the collection duct 13*a* is in a position where an angle θ formed by the vertical axis and the collection duct 13*a* is not larger than 45°. In other words, by setting an angle, at which the toner is flown through the collection duct 13*a*, to the horizontal plane to an angle not smaller than 45° and not larger than 90°, the toner can fall into the collected-toner box 14 by gravity with the simple structure of the collection duct 13*a*.

Figure 8A:
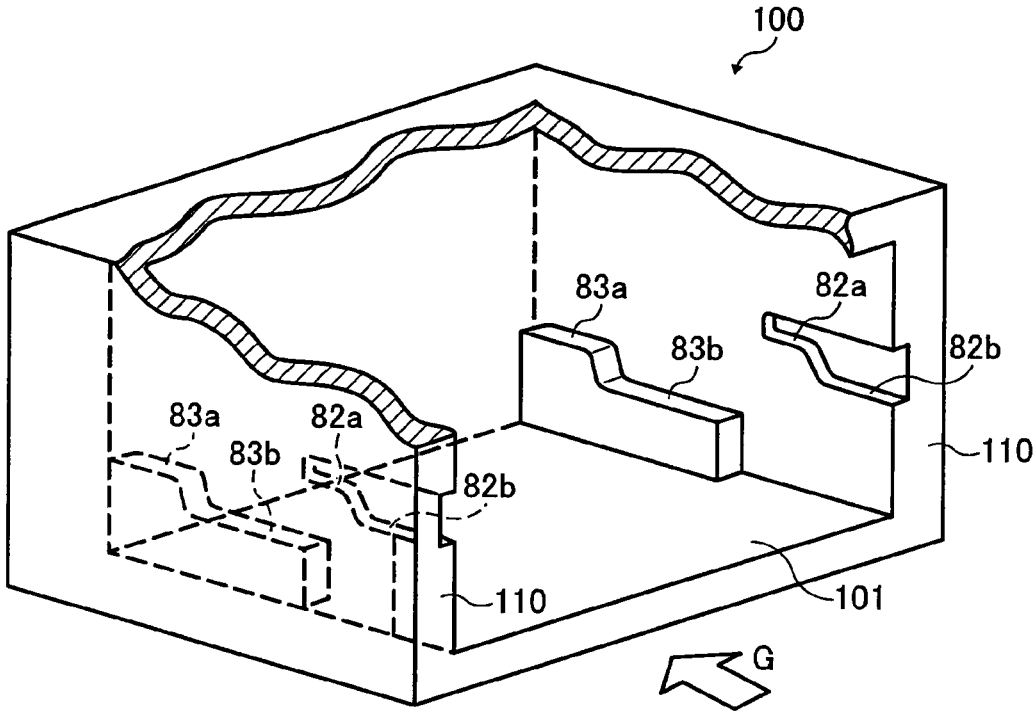
FIG. 8A is a perspective cut-away view of a printer body.

The processes involved in setting the intermediate transfer unit 80 on the printer body will be explained below. FIG. 8A is a perspective cut-away view of the printer 100, and FIG. 8B is a schematic perspective view of the intermediate transfer unit 80.

Figure 8B:
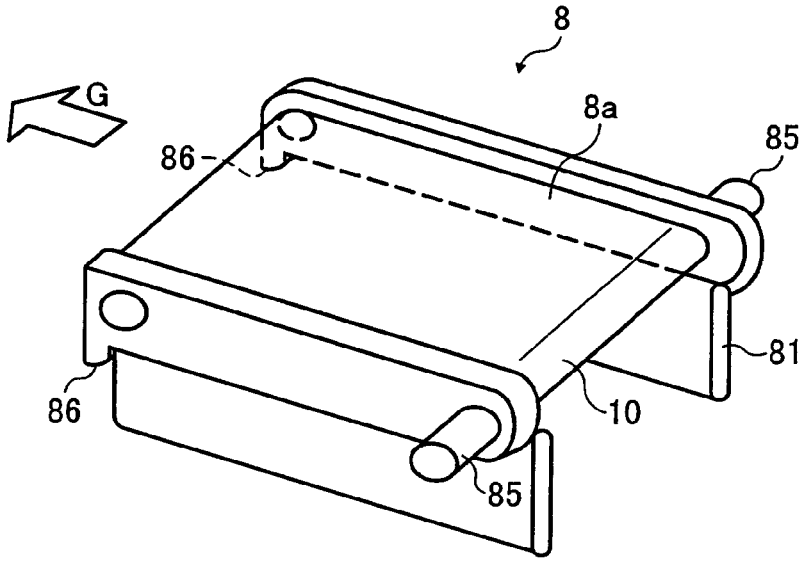
FIG. 8B is a schematic perspective view of the intermediate transfer unit.

As shown in FIG. 8B, the intermediate transfer unit 80 includes main reference portions 85 that serve as upper-unit positioning members, and sub reference portions 86 that serve as upper-unit positioning members. The main reference portions 85 are on the two edges of the transfer opposed roller 10 in the unit width direction, the transfer opposed roller 10 being on the trailing edge of the intermediate transfer unit 80 in the attachment direction. The sub reference portions 86 are on the leading edge of the intermediate transfer unit in the attachment direction.

As shown in FIG. 8A, each of the side plates 110 has a main-reference-portion receiving portion 82*a* for positioning the main reference portion 85 on the printer body, and a sub-reference-portion receiving portion 83*a* for positioning the sub reference portion 86 on the printer body.

By sliding the intermediate transfer unit 80 on the bottom plate 101, the intermediate transfer unit 80 is attached to the printer 100 in the direction indicated by an arrow G shown in FIGS. 8A and 8B.

Figure 9A:
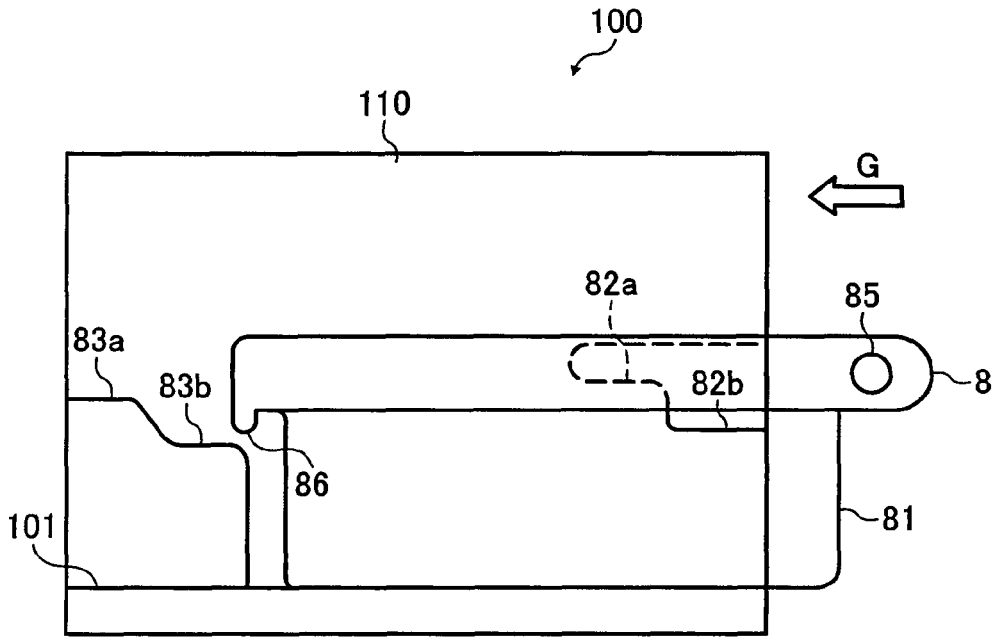
FIG. 9A is a schematic side view of the printer, depicting the state before positioning of the intermediate transfer unit.
Figure 9B:
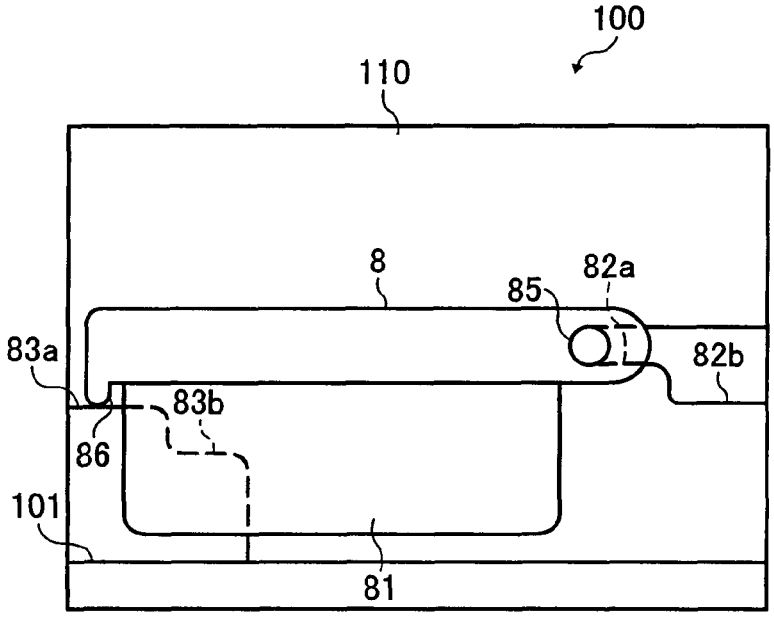
FIG. 9B is a schematic side view of the printer, depicting the state after positioning of the intermediate transfer unit.

FIG. 9A is a schematic side view of the printer 100, depicting the state before positioning the intermediate transfer unit 80 on the printer body, and FIG. 9B is a schematic side view of the printer 100, depicting the state after positioning the intermediate transfer unit 80 on the printer body.

As shown in FIG. 9A, when the intermediate transfer unit 80 slides on the bottom plate 101 in the direction, which is indicated by the arrow G shown in FIG. 8A, the lower edges of the stand members 81 are in contact with the bottom plate 101. The main reference portions 85 passes through main-reference-portion sliding portions 82*b* at the front of the main-reference-portion receiving portions 82*a*, and the sub reference portions 86 pass through sub-reference-portion sliding portions 83*b* at the front of the sub-reference-portion receiving portions 83*a*. When the intermediate transfer unit 80 shown in FIG. 9A is further pushed into the printer body, the main reference portions 85 lift up respectively along rear sloping surfaces of the main-reference-portion sliding portions 82*b*, and reach the main-reference-portion receiving portions 82*a* and bumps against the rear surfaces of the main-reference-portion receiving portions 82*a*. Meanwhile, the sub reference portions 86 lift up respectively along rear sloping surfaces of the sub-reference-portion sliding portions 83*b*, and reach the sub-reference-portion receiving portions 83*a* and bumps against the rear surfaces of the sub-reference-portion receiving portions 83*a*. In this manner, the main reference portions 85 and the sub reference portions 86 are positioned in the printer 100 as shown in FIG. 9B.

After the positioning, the lower edges of the stand members 81 are not in contact with the bottom plate 101 because the main reference portions 85 and the sub reference portions 86 lift up during the positioning.

Because improper positioning of the intermediate transfer unit 80 on the printer body leads to deterioration in image quality, accurate positioning of the intermediate transfer unit 80 is required. If the stand members 81 are positioned on the printer body instead of the main reference portions 85 and the sub reference portions 86, the stand members 81 need to be manufactured with high accuracy and attached to the intermediate-transfer-unit body with high accuracy. This results in the cost increase. On the other hand, in the case where the main reference portions 85 and the sub reference members 86 are provided as described above for the positioning of the intermediate transfer unit 80 on the printer body, the accuracy in manufacturing and attachment of the stand members 81, which would otherwise be required, can be lowered.

As described, the stand members 81 assist in the attachment or detachment of the intermediate transfer unit 80. After the positioning, the stand members 81 are not in contact with the bottom plate 101 as shown in FIG. 9B. In other words, the intermediate transfer unit 80 does not vertically interrupt the main reference portion 85 and the sub reference portions 86.

Explanation is given below about a locking unit serving as an upper-unit detachment preventing unit that prevents the intermediate transfer unit 80 being attached to the printer 100 from moving in the detachment direction.

Figure 10:
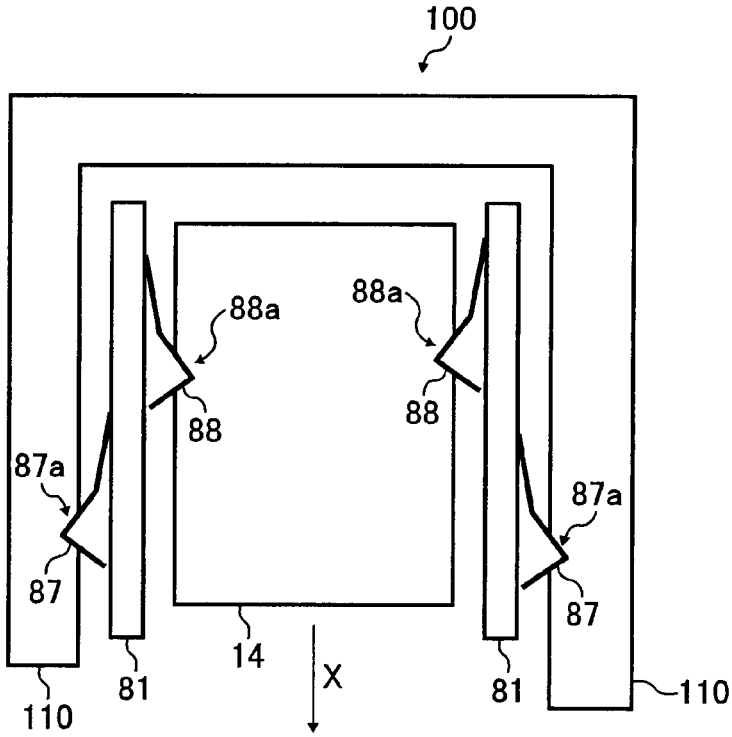
FIG. 10 is a schematic upper view of the printer for explaining a locking mechanism.

FIG. 10 is a schematic upper view of the printer 100 for explaining the locking unit. As shown in FIG. 10, each of the stand members 81 includes an exterior leaf spring 87 that faces a corresponding one of the side plates 110, and each of the side plates 110 includes a side-plate recess portion 87*a* in which the exterior leaf spring 87 fits. When the intermediate transfer unit 80 is inserted into the printer body to position the intermediate transfer unit 80 as shown in FIG. 9B, the exterior leaf springs 87 fit respectively in the side-plate recess portions 87*a*. Accordingly, the intermediate transfer unit 80 is locked on the side plates 110. Hence, the intermediate transfer unit 80 can be prevented from moving in the detachment direction indicated by the arrow X shown in FIG. 10.

Note that the intermediate transfer unit 80 is unlocked easily from the side plates 110 by pulling forward the intermediate transfer unit 80 from the printer body.

In addition, each of the stand members 81 includes an interior leaf spring 88 that faces the collected-toner box 14, and the collected-toner box 14 includes recess portions 88*a* in each of which a corresponding one of the interior leaf springs 88 fits. Each of the recess portions 88*a* is positioned on each of the two edges of the collected-toner box 14 in the unit width direction. When the collected-toner box 14 is inserted into the printer body after the positioning of the intermediate transfer unit 80, each of the interior leaf springs 88 fits in each of the recess portions 88*a* and the collected-toner box 14 is positioned below the intermediate transfer unit 80. Accordingly, the collected-toner box 14 is locked on the intermediate transfer unit 80. Because the intermediate transfer unit 80 is locked in the printer body, collected-toner box 14 can be prevented from moving in the detachment direction indicated by the arrow X shown in FIG. 10.

Note that the collected-toner box 14 is unlocked easily from the intermediate transfer unit 80 by pulling forward the collected-toner box 14.

The locking unit is not limited to the exterior leaf springs 87 and the interior leaf springs 88. For example, if the stand members 81 are made of resin, a snap-fit shape can be provided to each of the stand members 81 instead of the interior leaf springs 88 to lock the intermediate transfer unit 80 on the collected-toner box 14.

The stand members 81 are detachably attached to the intermediate-transfer-unit body 8. Hence, only the intermediate-transfer-unit body 8 in a small volume can be transferred. Alternatively, the stand member 81 can be configured to be foldable such that the intermediate transfer unit 80 can be small in volume when transferred.

In the first embodiment is explained the intermediate transfer unit 80 including the stand members 81 that serve as unit legs and that are positioned on the two edges of the intermediate-transfer-unit body 8 in the unit width direction. Alternatively, the intermediate transfer unit 80 can be configured to include a single stand member provided any one of the two edges of the intermediate-transfer-unit body in the unit width direction, and a guided member provided to the other edge and configured to slide on a guide rail provided in the printer body.

Figure 11:
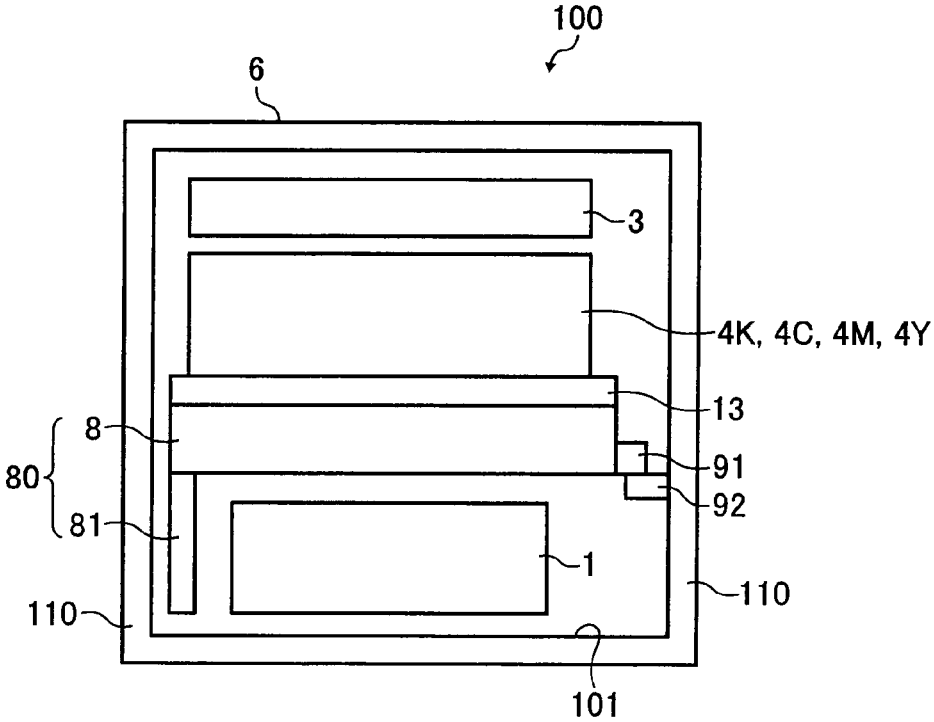
FIG. 11 is a schematic front view of a modification of the printer with an exterior front cover open.

FIG. 11 is a schematic front view of a modification of the printer 100 whose exterior front cover 5 is open.

As shown in FIG. 11, the intermediate transfer unit 80 includes the stand member 81 on a right one of the two edges of the intermediate-transfer-unit body 8 in the unit width direction in FIG. 11, and a guided member 91 provided on the other left edge and supported by a guide rail 92 provided to the side plate 110 on the left in FIG. 11.

The modification shown in FIG. 11 can have the same structure of the intermediate transfer unit 80 of the first embodiment, excluding the stand member 81 on the right edge and the guided member 91 on the left edge.

The fall of the intermediate transfer unit 80 during the attachment or detachment occurs in a manner that the intermediate transfer unit 80 pivots on the trailing edge portion that the user grips and the leading edge of the intermediate transfer unit 80 falls while the user is supporting the trailing edge portion. To prevent the fall of the intermediate transfer unit 80, the stand member 81 is provided on one of the two edges of the intermediate-transfer-unit body 8 in the unit width direction. The stand member 81 prevents the pivoting of the intermediate transfer unit 80, thus preventing the leading edge of the intermediate transfer unit 80 from falling.

Because the stand member 81 has a surface at a level equivalent to that of the guide rail 92, the guided member 91 is put on the guide rail 92 by only sliding the stand member 81 such that the lower edge of the stand member 81 is in contact with the bottom plate 101. With the above structure, the user needs not to see where the guide rail is to insert or pull forward the intermediate transfer unit 80 from the printer body. Accordingly, the intermediate transfer unit 80 and other units can be prevented from being damaged during the inserting or pulling out of the intermediate transfer unit 80 from the printer body.

Because the stand member 81 is provided on the only one of the two edges of the intermediate transfer unit 80 in the unit width direction, the intermediate transfer unit in the modification interrupts only one of the edges of the collected-toner box 14 in the unit width direction. In other words, the edge of the collected-toner box 14 on which the guide rail 92 is provided is not interrupted by the stand member 81, and the printer body and the collected-toner box 14 can be connected easily.

In the first embodiment and its modification explained above, the intermediate transfer unit 80 serves as an upper unit that includes at least one stand member. In a second embodiment of the present invention described below, a transfer-conveying unit serves as the upper unit.

Figure 12:
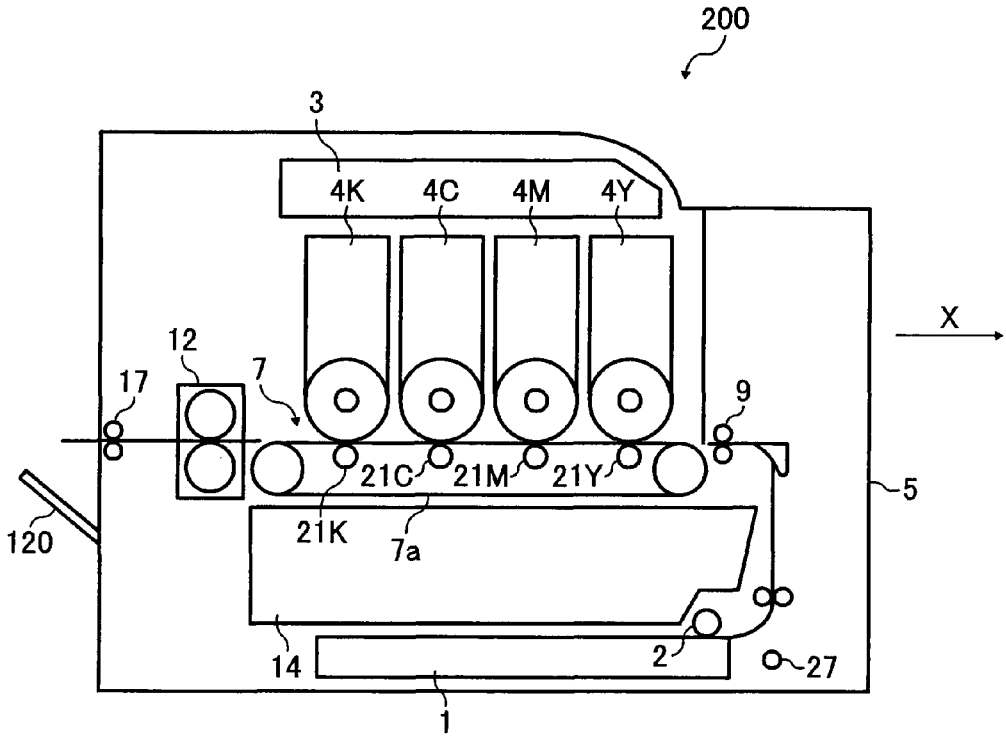
FIG. 12 is a schematic side view of a printer according to a second embodiment of the present invention.

FIG. 12 is a schematic side view of a printer 200 according to the second embodiment. The printer 200 includes a transfer conveying unit 70 that includes a transfer-conveying belt 7*a* that is wound around and extends across a plurality of rollers and that is positioned at approximately the center of a printer body of the printer 200. Along an upper surface of the transfer-conveying belt 7*a*, the image forming units 4 (4K, 4C, 4M, and 4Y) each include a photoreceptor are arranged. Above the image forming units 4, the exposure unit 3 that applies a light beam to each of the photoreceptors is arranged. On the inner surface of the transfer-conveying belt 7*a*, four transfer rollers 21 (21K, 21C, 21M, and 21Y) are provided in portions that face respectively the photoreceptors.

Below a transfer-conveying-unit body 7 is provided the collected-toner box 14 for storing residual toner on the transfer-conveying belt 7*a* and on the surfaces of the photoreceptors after the residual toner is removed and collected. Below the collected-toner box 14, the sheet cassette 1 is arranged.

A full color image is formed in the printer 200 in the following manner. The exposure unit 3 applies each light beam to each of the photoreceptors of the image forming units 4 so that each color toner image is formed on each of the surfaces of the photoreceptors.

Transfer sheets stacked on the sheet cassette 1 are fed by the feeding roller 2 one by one and then reach the resist rollers 9. The transfer sheet is fed by the resist rollers 9 at a timing such that the color toner images on the surfaces of the photoreceptors are transferred to the transfer sheet on the transfer-conveying belt 7*a* at transfer positions that faces the transfer rollers 21K, 21C, 21M and 21Y. Accordingly, a layered color toner image is formed on the surface of the transfer sheet. During the transfer, the transfer sheet is conveyed on and by the transfer-conveying belt 7*a*.

The transfer sheet having the layered color toner image thereon is conveyed on the transfer-conveying belt 7*a* to the fixing unit 12 to fix the layered color toner image. After the layered color toner image is fixed as an image on the surface of the transfer sheet, the transfer sheet is discharged to a discharged-sheet tray 120. Residual toner removed from the transfer-conveying belt 7*a* and the surfaces of the photoreceptors is stored in the collected-toner box 14.

As in the case of the printer 100, a user stands on the side of an arrow X shown in FIG. 12 (hereinafter, "front side") and performs operations, maintenance work of the printer 200, and replacement of consumed parts.

Figure 13:
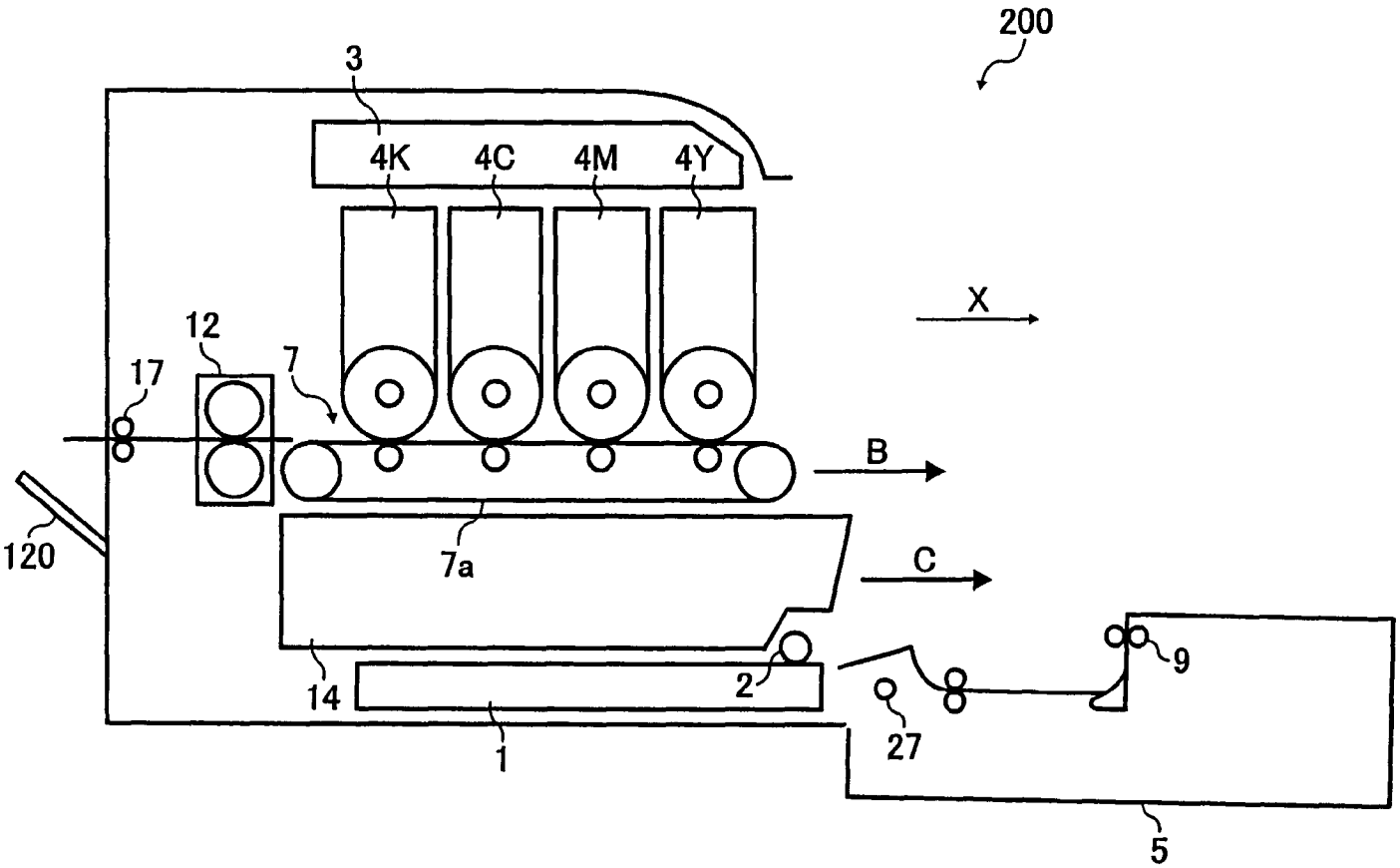
FIG. 13 is a schematic side view of the printer shown in FIG. 12 with the exterior front cover open.

FIG. 13 is a schematic side view of the printer 200 whose exterior front cover 5 is open, for explaining directions in which the units of the printer 200 are detached. The exterior front cover 5 is caused to pivot on the exterior-front-cover pivot shaft 27 to be opened in the direction indicated by the arrow X shown in FIG. 13. Accordingly, the transfer conveying unit and the collected-toner box 14 can be detached from the printer body respectively in the directions indicated by arrows B and C shown in FIG. 13.

Figure 14:
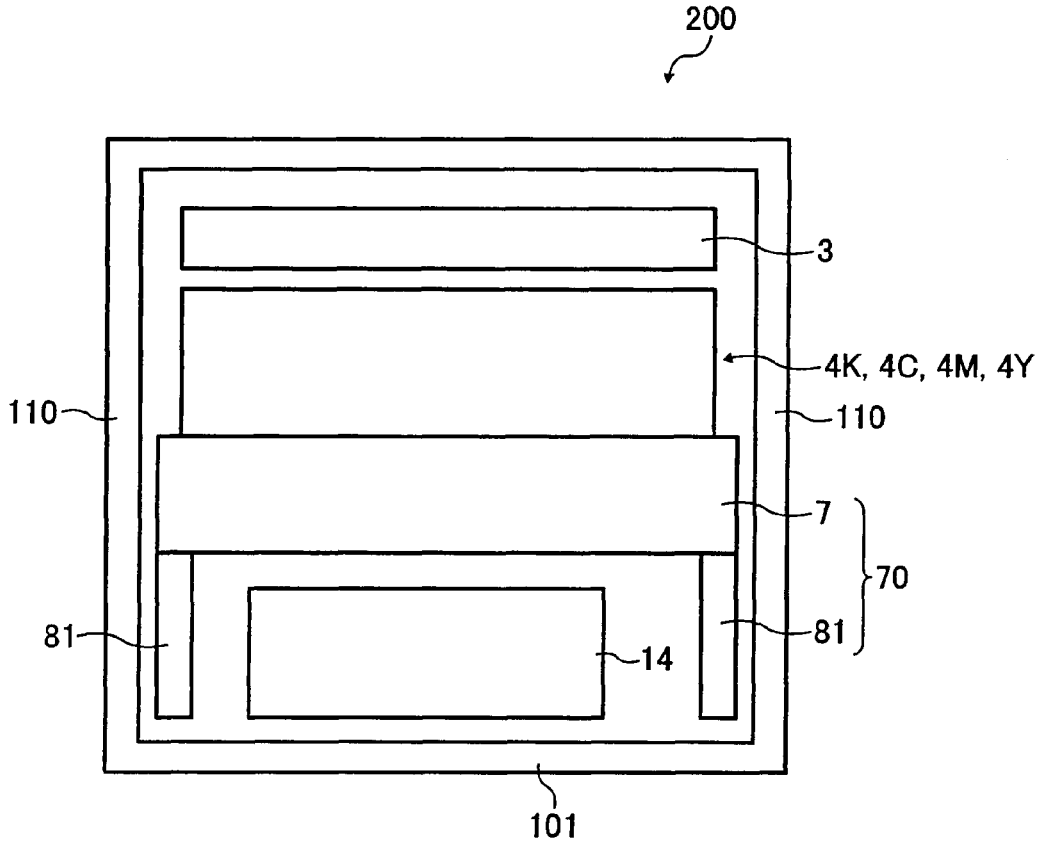
FIG. 14 is a schematic front view of the printer shown in FIG. 12 with the exterior front cover.

FIG. 14 is a schematic front view of the printer 200 whose exterior front cover 5 is open, viewed from the front side. The units of the printer 200 are arranged so as to be seen from a certain direction at a time. This means that all the units can be detached from or attached to the printer body in the direction indicated by the arrow X shown in FIG. 13.

The printer 200 shown in FIG. 14 includes the transfer conveying unit 70 that is positioned at almost the center of the printer 200. On the contrary, the printer 100 shown in FIG. 3 includes the intermediate transfer unit 80 that is positioned at almost the center of the printer 100 and that includes the cleaning unit 13. Other units of the printer 200 are arranged as in the printer 100, and thus, the transfer conveying unit 70 can be detached from and attached to the printer body with the same structure as that of the intermediate transfer unit 80. Such a structure prevents a leading edge of the transfer conveying unit 70 in a direction, in which the transfer conveying unit 70 is attached to the printer body, from falling and bumping against, for example, the bottom plate 101, thereby preventing damage of the transfer conveying unit 70 during its detachment or attachment.

As shown in FIGS. 12 and 13, the printer 200 includes the exterior front cover 5 on the right in FIGS. 12 and 13 and the fixing unit 12 on the left side. In addition, the exterior front cover 5 includes a transfer-conveying path that extends from the sheet cassette 1 to the transfer conveying unit 70.

Alternatively, the fixing unit 12 can be provided to the exterior front cover 5 (on the right in FIG. 12) and the transfer-conveying path can be positioned in the apparatus body on a rear side (on the left in FIG. 12) opposite to the front side such that the transfer conveying unit 70 is positioned between the transfer path and the exterior front cover 5. With the structure, the transfer sheet is fed to the transfer conveying unit 70 and conveyed by and on the transfer-conveying belt 7*a* from the rear side to the front side. Because the fixing unit 12 is provided to the exterior front cover 5, all of the units inside the printer 200 can be seen in the single direction when the exterior front cover 5 opens.

As described, the printer 200 includes the stand members 81 that are integral with the intermediate-transfer-unit body 8. Each of the stand members 81 stretches below the transfer-conveying-unit body 7 from the leading edge to the trailing edge of the transfer-conveying-unit body 7 along the attachment direction. In other words, the stand members 81 are positioned also on the leading edge of the transfer-conveying-unit body in the attachment direction. Accordingly, when the transfer conveying unit 70 is to pivot on the trailing edge portion that the user grips in the process of attachment or detachment of the transfer conveying unit 70, the leading edges of the stand members 81 in the attachment direction prevents the pivoting of the transfer conveying unit 70. Hence, the leading edge portion of the transfer conveying unit 70 in the attachment direction can be prevented from falling and bumping against, for example, the bottom plate 101.

In the printer 100, the lower edges of the stand members 81 are in contact with the bottom plate 101 during the attachment or detachment. Hence, by sliding the intermediate transfer unit 80 on the bottom plate 101 while the lower edges of the stand members 81 are in contact with the bottom plate 101, the intermediate transfer unit 80 can be detached from and attached to the printer body. Accordingly, the leading edge of the intermediate transfer unit 80 can be prevented from falling and damaging, for example, the bottom plate 101 when the user fails to grip properly the trailing edge portion of the intermediate transfer unit 80 in the detachment/attachment direction.

Because the intermediate transfer unit 80 includes the stand members 81 on the two edges of the intermediate transfer-unit body in the unit width direction, the lower edges of the stand members 81 can be kept being in contact with the bottom plate 101 without a force to be vertically applied to the intermediate transfer unit 80. Accordingly, by only applying a force to slide the intermediate transfer unit 80 on the bottom plate 101, the intermediate transfer unit 80 can be attached to and detached from the printer body. Thus, the detachment/attachment characteristics of the intermediate transfer unit 80 can be improved, especially because the intermediate transfer unit 80 is configured to slide to a position above the opened exterior front cover 5 as shown in FIG. 4B.

In addition, the intermediate-transfer-unit body 8 is not in contact with the bottom plate 101 during the process of attachment or detachment. In addition, the intermediate-transfer-unit body is not in contact with the bottom plate 101 while being attached to or detached from the printer body. Hence, the collected-toner box 14 can be provided as the lower unit right below the intermediate-transfer-unit body 8 and above the bottom plate 101.

The intermediate-transfer-unit body 8, the collected-toner box 14, and the stand members 81 are arranged such that, as shown in FIG. 3, the stand members 81 are exterior of the two edges of the collected-toner box 14 in the unit width direction when the intermediate transfer unit 80 and the collected-toner box 14 are attached to the printer 100. Accordingly, the intermediate-transfer-unit body, the collected-toner box 14, and the stand members 81 can be attached to or detached from the printer body in the single direction.

The printer 100 includes the secondary transfer unit 11*a* that serves as the opening-side unit and that includes a recording-medium transfer unit and a recording-medium conveying unit. After the attachment of the intermediate transfer unit 80, the secondary transfer unit 11*a* is attached to the printer 100 on the front side. The width M of the secondary transfer unit 11*a* is equivalent to or larger than the width m of the intermediate transfer unit 80. If the guide rails are provided for the intermediate transfer unit 80 as in the printer 100, the guide rail cannot extend in the printer body to the space where the secondary transfer unit 11*a* is positioned when the exterior front cover 5 is closed. With this structure, the user needs to see where the guide rails are for the detachment and attachment of the intermediate transfer unit 80. Hence, the intermediate transfer unit 80 may sometime bump against other members of the printer 100 and the intermediate transfer unit 80 and other members of the printer 100 may get damaged. With the structure of the first embodiment, on the other hand, the stand members 81 are in contact with the bottom plate 101 while the intermediate transfer unit 80 slides on the bottom plate 101 to be attached to or detached to the printer body. Accordingly, the user needs not to see where the guide rails are even though the unit having the larger width than that of the intermediate transfer unit 80 is provided to the printer 100 on the front side. Hence, the damage of the intermediate transfer unit 80 and other members of the printer 100 can be prevented, which would otherwise occur by repetition of the inserting and pulling forward of the intermediate transfer unit 80 from the printer body.

In addition, because the secondary transfer unit 11*a* serves as the opening-side unit including the recording-medium transfer unit and the receding-medium conveying unit, the detachment or attachment of the recording-medium transfer unit and the receding-medium conveying unit is easy. Hence, the maintenance work for the recording-medium transfer unit and the receding-medium conveying unit are easy.

The collected-toner box 14 includes the positioning pin 141 that serves as a lower-unit connecting member that connects to the side plate 110 on a corresponding one of the edges of the collected-toner box 14 in the unit width direction, and a corresponding one of the stand members 81 has the cutout 81*a* through which the positioning pin 141 penetrates. Because of the cutout 81*a*, the stand member 81 does not occupy the space between the collected-toner box 14 and the side plate 110, and the collected-toner box 14 can be positioned on the printer body.

The stand members 81 each include the interior leaf spring 88 as the lower-unit detachment preventing unit to prevent the collected-toner box 14 from moving in the detachment direction when the intermediate transfer unit 80 and the collected-toner box 14 are attached to the printed body. Hence, the collected-toner box 14 can be prevented from falling off. In addition, since the stand members 81 that are close to the collected-toner box 14 include the locking unit, the structure of the lower-unit-detachment preventing unit can be simplified.

Because the intermediate transfer unit 80 serves as the upper unit, the detachment or attachment of the intermediate transfer unit 80 is possible without damaging the intermediate transfer belt 8*a*.

Because the collected-toner box 14 serves as the collected-toner storage unit and the lower unit, the collected toner can be removed out of the printer 100 easily.

The cleaning unit 13 serving as the cleaning unit can be detachably attached to the printer body along with the intermediate transfer unit 80. Hence, it suffices that the cleaning unit 13 be fixed to the intermediate transfer unit 80, and other structure for attachment or detachment of the cleaning unit 13 is unnecessary. Thus, the space for such a structure can be omitted.

The collected-toner box 14 includes the collection duct 13*a* on one of the edges of the collected-toner box 14 in the unit width direction. The collection duct 13*a* serves as a collected-toner conveying unit for conveying the residual toner from the cleaning unit 13 to the collected-toner box 14. The stand member 81 has the duct cutout 81*b* through which the collection duct 13*a* penetrates. Because of the duct cutout 81*b*, the residual toner can be conveyed from the cleaning unit 13 above the intermediate transfer unit 80 to the collected-toner box 14 below the intermediate transfer unit 80 without interruption by the stand member 81.

Because the collected toner can be conveyed trough the collection duct 13*a* in a direction having an angle not smaller than 45° and not larger than 90° to the horizontal plane. Thus, the collected toner can fall into the collected-toner box 14 by gravity. In this manner, the structure of the collection duct 13*a* can be simplified.

The intermediate transfer unit 80 includes, as the upper-unit-positioning members for positioning the intermediate transfer unit 80 in the printer 100, the main reference portions 85 and sub reference portions 86. Hence, the accuracy with respect to the stand members, that would other wise required, can be lowered. For this reason, it suffices that a certain rigidity and height of the stand members 81 be assured, and thus, the stand members 81 can be manufactured at low cost.

Through the positioning operation, the intermediate transfer unit 80 is inserted into the rear side of the printer body such that the main reference portions 85 are positioned on the main-reference-portion receiving portions 82*a* and the sub reference portions 86 are positioned on the sub-reference-portion receiving portions 83*a*. Accordingly, the intermediate transfer unit 80 lifts up during the positioning, and the lower edges of the stand members 81 are not in contact with the bottom plate 101 after the positioning. As described, the stand members 81 merely assist the positioning of the intermediate transfer unit 80, and do not directly position the intermediate transfer unit 80. Hence, the positioning of the intermediate transfer unit 80 on the printer body can be securely performed.

The stand members 81 include the exterior leaf springs 87 as the upper-unit detachment preventing unit that prevents the intermediate transfer unit 80 from moving in the detachment direction when the intermediate transfer unit 80 is attached to the printer 100. The exterior leaf springs 87 prevent the intermediate transfer unit 80 from falling. In addition, because of the locking unit provided to the stand members 81, the structure of the upper-unit detachment preventing unit can be simplified.

If the stand members 81 are made of resin, the snap-fit shapes can be provided to the stand members 81 to lock the intermediate transfer unit 80 on the collected-toner box 14, reducing the number of members of the printer 100.

By configuring the stand members 81 to be foldable, the volume of the intermediate transfer unit 80 can be small upon the transfer of the intermediate transfer unit 80. Hence, the handling characteristics of the intermediate transfer unit 80 improve.

By configuring the stand members 81 to be detachably attached to the intermediate-transfer-unit body 8, the volume of the intermediate transfer unit 80 can be small upon the transfer of the intermediate-transfer-unit body 8. Hence, the handling characteristics of the intermediate transfer unit 80 improve.

The same advantages of the intermediate transfer unit 80 can be realized with the transfer conveying unit 70.

According to an aspect of the present invention, the upper unit can be prevented from being damaged.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

an apparatus body including:

two side surfaces opposing each other, and a bottom surface; and an upper unit configured to be detachably attached to the apparatus body in a space between the two side surfaces by movement in an attachment/detachment direction that is parallel to the two side surfaces and the bottom surface, wherein the upper unit includes a unit body and a unit leg, the unit leg extending from the unit body toward the bottom surface, and the unit leg is positioned at least on a leading edge of the unit body in an attachment direction, wherein the unit leg is configured so that a lower edge of the unit leg slides on the bottom surface during a process of attachment or detachment of the upper unit from the apparatus body, and wherein the upper unit is configured such that the unit body is not in contact with the bottom surface when the upper unit is attached to or detached from the apparatus body.

2. The image forming apparatus according to claim 1, further comprising a lower unit that can be detachably attached to the apparatus body so as to be positioned right under the unit body and above the bottom surface.

3. The image forming apparatus according to claim 2, wherein, when the lower unit is attached to the apparatus body, the unit leg is exterior to a corresponding one of two edges of the lower unit in a direction orthogonal to the attachment/detachment direction.

4. The image forming apparatus according to claim 3, further comprising a secondary unit fixed to a cover of the apparatus body on an interior side, from which the upper unit is attached to and detached from the apparatus body, wherein a width of the secondary unit along the direction orthogonal to the attachment/detachment direction is larger than a corresponding width of the upper unit.

5. The image forming apparatus according to claim 4, wherein the secondary unit includes a recording-medium transfer unit that transfers a toner image from a toner image carrier to a recording medium.

6. The image forming apparatus according to claim 4, wherein the secondary unit includes a recording-medium conveying unit that conveys the recording medium.

7. The image forming apparatus according to claim 3, wherein the lower unit includes a lower-unit connecting member that is positioned on a corresponding one of two edges of the lower unit in the direction orthogonal to the attachment/detachment direction, and that connects to a corresponding one of the side surfaces, and the unit leg has any one of a through-hole and a cutout through which the lower-unit connecting member penetrates.

8. The image forming apparatus according to claim 3, wherein the unit leg includes a lower-unit-detachment preventing unit that prevents the lower unit from moving in a detachment direction of the lower unit from the apparatus body when the upper unit and the lower unit are attached to the apparatus body.

9. The image forming apparatus according to claim 3, wherein the upper unit is an intermediate transfer unit that includes an intermediate transfer medium to which toner images are primary-transferred from image carriers and from which a resultant toner image is secondary-transferred to a recording medium.

10. The image forming apparatus according to claim 9, further comprising a cleaning unit that cleans and collects residual toner remaining on surfaces of the image carriers after the toner images are primary-transferred to the intermediate transfer medium, and residual toner remaining on a surface of the intermediate transfer medium after the resultant toner image is secondary-transferred to the recording medium, wherein the lower unit is a collected-toner storage unit that stores therein the residual toner collected by the cleaning unit.

11. The image forming apparatus according to claim 10, wherein the cleaning unit is integral with the intermediate transfer unit and is configured to be detachably attached to the apparatus body.

12. The image forming apparatus according to claim 3, wherein the upper unit is a recording-medium transfer-conveying unit that transfers toner images from image carriers to a recording medium and conveys the recording medium.

13. The image forming apparatus according to claim 12, further comprising a cleaning unit that cleans and collects residual toner remaining on surfaces of the image carriers after the toner images are primary-transferred to the intermediate transfer medium, and residual toner remaining on a surface of the intermediate transfer medium after the resultant toner image is secondary-transferred to the recording medium, wherein the lower unit is a collected-toner storage unit that stores therein the residual toner collected by the cleaning unit.

14. The image forming apparatus according to claim 1, wherein the upper unit further includes an upper-unit positioning member for positioning the upper unit in the apparatus body.

15. The image forming apparatus according to claim 1, wherein the upper unit further includes an upper-unit positioning unit for positioning the upper unit in the apparatus body by a positioning operation during a process of attachment of the upper unit to the apparatus body, wherein the upper unit moves up by the positioning operation, and wherein a lower edge of the unit leg is not in contact with the bottom surface during the positioning operation.

16. The image forming apparatus according to claim 1, wherein the unit leg includes an upper-unit detachment preventing unit that prevents the upper unit from moving in the attachment/detachment direction, when the upper unit is attached to the apparatus body.

17. The image forming apparatus according to claim 1, wherein the unit leg is foldable with respect to the unit body.

18. The image forming apparatus according to claim 1, wherein the bottom surface substantially spans a width and a length of an interior of the apparatus body such that the bottom surface is supported by at least the two opposing side surfaces.

19. An image forming apparatus comprising:

an apparatus body having two side surfaces, which are opposed to each other, and a bottom surface that spans a width and a length of the apparatus body and adjoins a bottom end of each side surface; and an upper unit that can be detachably attached to the apparatus body in a space between the two side surfaces by movement in an attachment/detachment direction that is parallel to the two side surfaces and the bottom surface, wherein the upper unit includes a unit body and a unit leg, the unit leg extending from the unit body toward the bottom surface and is spaced apart from the side surfaces of the apparatus body and any attachments thereto, and the upper unit is configured such that the unit body is not in contact with the bottom surface when the upper unit is attached to or detached from the apparatus body.

20. An image forming apparatus comprising:

an intermediate transfer unit that includes an intermediate transfer medium to which toner images are primary-transferred from image carriers and from which a resultant toner image is secondary-transferred to a recording medium;

a secondary transfer unit that is opposed to the intermediate transfer medium and is configured to transfer the resultant toner image on the intermediate transfer medium to the recording medium;

a cleaning unit that cleans and collects residual toner remaining on a surface of the intermediate transfer medium after the resultant toner image is secondary-transferred to the recording medium;

a collected-toner storage unit that stores therein the residual toner collected by the cleaning unit; and an apparatus body including:

two side surfaces that are opposed to each other and extend in a direction from a front to a rear of the apparatus body, and a bottom surface that spans a width and a length of the apparatus body and adjoins each of the side surfaces; and an opening and closing cover that is pivotally attached to the apparatus body, wherein the intermediate transfer unit is detachably attached to the apparatus body in a space between the two side surfaces by movement in the direction from the front to the rear of the apparatus body that is an attachment/detachment direction parallel to the two side surfaces, wherein the intermediate transfer unit includes a unit body and a pair of unit legs, each of the unit legs extending from the unit body toward the bottom surface, wherein the unit body includes the intermediate transfer medium, wherein each of the unit legs includes a slide portion that slides on the apparatus body, and the slide portion is positioned such that a first distance between the slide portion and the bottom surface is less than a second distance between the unit body and the bottom surface, wherein the intermediate transfer unit is configured such that the unit body is not in contact with the bottom surface when the intermediate transfer unit is attached to or detached from the apparatus body, wherein the collected-toner storage unit is positioned between the unit legs, under the intermediate transfer medium and above the bottom surface, and wherein the secondary transfer unit is attached to the opening and closing cover.

21. The image forming apparatus according to claim 20, wherein the slide portion is a lower edge of the unit leg and is in contact with the bottom surface.

22. The image forming apparatus according to claim 20, wherein each of the unit legs is provided on the unit body and a length of each unit leg extends entirely from the front to the rear of the apparatus body.

23. The image forming apparatus according to claim 20, wherein the unit legs are integral with the unit body.

24. The image forming apparatus according to claim 20, wherein the collected-toner storage unit is attached to the apparatus body detachably in a same direction as the attachment/detachment direction of the intermediate transfer unit.

25. The image forming apparatus according to claim 24, wherein the collected-toner storage unit and the intermediate transfer unit are individually detachable from the apparatus body.

26. The image forming apparatus according to claim 20, further comprising:

a resist roller that conveys the recording medium to a secondary transfer point;

a fixing unit that fixes the resultant toner image transferred to the recording medium at the secondary transfer point; and a transfer path of the recording medium that extends from a downstream side of the fixing unit to an upstream side of the resist roller, wherein the resist roller, the fixing unit, and the transfer path are attached to the opening and closing cover.

27. The image forming apparatus according to claim 20, wherein the cleaning unit collects residual toner remaining on surfaces of the image carriers after the toner images are primary-transferred to the intermediate transfer medium.

28. The image forming apparatus according to claim 20, wherein the cleaning unit is in contact with an upper side surface of the intermediate transfer medium, and is configured to be detachable together with the intermediate transfer unit integral therewith from the apparatus body.

29. The image forming apparatus according to claim 20, further comprising:

a collection duct that conveys the residual toner collected by the cleaning unit from the cleaning unit to the collected-toner storage unit.

30. The image forming apparatus according to claim 20, wherein the slide portion is positioned lower than the intermediate transfer medium.

31. An image forming apparatus comprising:

an intermediate transfer unit that includes an intermediate transfer medium to which toner images are primary-transferred from image carriers and from which a resultant toner image is secondary-transferred to a recording medium;

a cleaning unit that cleans and collects residual toner remaining on a surface of the intermediate transfer medium after the resultant toner image is secondary-transferred to the recording medium;

a collected-toner storage unit that stores therein the residual toner collected by the cleaning unit; and an apparatus body including:

two side surfaces that are opposed to each other, and a bottom surface that spans a width and a length of the apparatus body and adjoins each of the side surfaces, wherein the intermediate transfer unit is detachably attached to the apparatus body in a space between the two side surfaces by movement in an attachment/detachment direction that is parallel to the two side surfaces, wherein the intermediate transfer unit includes a unit body and a pair of unit legs, each of the unit legs extending from the unit body toward the bottom surface, wherein the unit body includes the intermediate transfer medium, wherein each of the unit legs includes a slide portion that slides on the apparatus body, and the slide portion is positioned such that a first distance between the slide portion and the bottom surface is less than a second distance between the unit body and the bottom surface, wherein the intermediate transfer unit is configured such that the unit body is not in contact with the bottom surface when the intermediate transfer unit is attached to or detached from the apparatus body, and wherein the collected-toner storage unit is positioned between the unit legs, under the intermediate transfer medium and above the bottom surface.

* * * * *